US008230952B2

(12) United States Patent
Schwefe et al.

(10) Patent No.: US 8,230,952 B2
(45) Date of Patent: Jul. 31, 2012

(54) SLEEVE STRUCTURES FOR EARTH-BORING TOOLS, TOOLS INCLUDING SLEEVE STRUCTURES AND METHODS OF FORMING SUCH TOOLS

(75) Inventors: Thorsten Schwefe, Spring, TX (US); Henning Finke, Lower Sachsony (DE); Thomas Ganz, Bergen (DE)

(73) Assignee: Baker Hughes Incorporated, Houston, TX (US)

( * ) Notice: Subject to any disclaimer, the term of this patent is extended or adjusted under 35 U.S.C. 154(b) by 110 days.

(21) Appl. No.: 12/182,653

(22) Filed: Jul. 30, 2008

(65) Prior Publication Data

US 2009/0032309 A1 Feb. 5, 2009

Related U.S. Application Data

(60) Provisional application No. 60/953,367, filed on Aug. 1, 2007.

(51) Int. Cl.
*E21B 10/42* (2006.01)

(52) U.S. Cl. ..... 175/408; 76/108.2

(58) Field of Classification Search ..... 175/408, 175/426; 76/108.2
See application file for complete search history.

(56) References Cited

U.S. PATENT DOCUMENTS

| | | | | |
|---|---|---|---|---|
| 3,825,083 | A | 7/1974 | Flarity et al. | |
| 3,833,077 | A * | 9/1974 | Lavallee | 175/325.2 |
| 4,440,247 | A * | 4/1984 | Sartor | 175/393 |
| 5,963,775 | A * | 10/1999 | Fang | 419/36 |
| 5,967,246 | A * | 10/1999 | Caraway et al. | 175/393 |
| 5,967,247 | A | 10/1999 | Pessier | |
| 6,006,845 | A | 12/1999 | Illerhaus et al. | |
| 6,138,780 | A | 10/2000 | Beuershausen | |
| 6,206,117 | B1 * | 3/2001 | Tibbitts et al. | 175/399 |
| 6,269,892 | B1 | 8/2001 | Boulton et al. | |
| 6,302,223 | B1 * | 10/2001 | Sinor | 175/393 |
| 6,349,780 | B1 | 2/2002 | Beuershausen | |
| 6,684,967 | B2 | 2/2004 | Mensa-Wilmot et al. | |
| 6,883,623 | B2 | 4/2005 | McCormick et al. | |
| 2005/0150656 | A1 * | 7/2005 | Stowe | 166/298 |
| 2006/0157286 | A1 * | 7/2006 | Pope | 175/374 |
| 2008/0047754 | A1 * | 2/2008 | Evans et al. | 175/61 |

OTHER PUBLICATIONS

Disclosure of Non-Patient Information Which May be Material to Patentability (15 total pages), (Jul. 30, 2008).

* cited by examiner

*Primary Examiner* — Shane Bomar
*Assistant Examiner* — Catherine Loikith
(74) *Attorney, Agent, or Firm* — TraskBritt

(57) ABSTRACT

Earth-boring tools comprise a bit body comprising a face and a plurality of blades extending radially outward over the face and forming gage regions. A shank is coupled to the bit body and includes a threaded portion for connecting to a drill string. A sleeve structure is positioned adjacent to the bit body and surrounds a portion of the shank, the sleeve structure extending from adjacent the bit body to proximate the threaded portion of the shank. An outer surface of the sleeve structure comprises a plurality of circumferentially spaced gage pads extending thereover and may comprise a plurality of breaker flats.

12 Claims, 4 Drawing Sheets

SLEEVE STRUCTURES FOR EARTH-BORING TOOLS, TOOLS INCLUDING SLEEVE STRUCTURES AND METHODS OF FORMING SUCH TOOLS

CROSS-REFERENCE TO RELATED APPLICATION

This application claims the benefit of U.S. Provisional Patent Application No. 60/953,367, filed Aug. 1, 2007, the entire disclosure of which is incorporated herein by this reference.

TECHNICAL FIELD

Embodiments of the present invention relate to earth-boring tools and, more particularly, to a sleeve coupled to earth-boring tools and to tools including such sleeves.

BACKGROUND

Drilling wells for oil and gas production conventionally employs longitudinally extending sections, or so-called "strings," of drill pipe to which, at one end, is secured a drill bit of a larger diameter. The drill bit conventionally forms a bore hole through the subterranean earth formation to a selected depth. Rotary drill bits are commonly used for drilling such bore holes or wells. One type of rotary drill bit is the fixed-cutter bit (often referred to as a "drag" bit), which typically includes a plurality of cutting elements secured to a face region of a bit body. Referring to FIG. 1, a conventional fixed-cutter rotary drill bit 100 includes a bit body 110 having a face 120 defining a proximal end and comprising generally radially extending blades 130, forming fluid courses 140 therebetween extending to junk slots 150 between circumferentially adjacent blades 130. Bit body 110 may comprise a metal or metal alloy such as steel or a particle-matrix composite material, both as known in the art.

The drill bit includes an outer diameter 155 defining the radius of the wall surface of a bore hole. The outer diameter 155 may be defined by a plurality of gage regions 160, which may also be characterized as "gage pads" herein. Gage regions 160 comprise longitudinally upward (as the drill bit 100 is oriented during use) extensions of blades 130. The gage regions 160 may have wear-resistant inserts and/or coatings, such as hardfacing material, tungsten carbide inserts, natural or synthetic diamonds, or a combination thereof, on radially outer surfaces 170 thereof as known in the art to inhibit excessive wear thereto so that the design borehole diameter to be drilled by the drill bit is maintained over time.

A plurality of cutting elements 180 are conventionally positioned on each of the blades 130. Generally, the cutting elements 180 have either a disk shape or, in some instances, a more elongated, substantially cylindrical shape. The cutting elements 180 commonly comprise a "table" of super-abrasive material, such as mutually bound particles of polycrystalline diamond, formed on a supporting substrate of a hard material, conventionally cemented tungsten carbide. Such cutting elements are often referred to as "polycrystalline diamond compact" (PDC) cutting elements or cutters. The plurality of PDC cutting elements 180 may be provided within cutting element pockets 190 formed in rotationally leading surfaces of each of the blades 130. Conventionally, a bonding material such as an adhesive or, more typically, a braze alloy may be used to secure the cutting elements 180 to the bit body 110.

The bit body 110 of a rotary drill bit 100 is secured to a steel shank 200 having an American Petroleum Institute (API) thread connection 205 for attaching the drill bit 100 to a drill string (not shown), in a conventional manner. A shoulder 210 is typically located on the shank 200 just distal to the thread connection 205. The shoulder 210 is conventionally substantially distant from the proximal portion of the bit body 110 which may affect the bending moment on the shank 200 in some applications, such as in directional drilling. The steel shank 200 typically also includes a plurality of breaker flats 300 configured as a flat surface providing a location which a tool can grasp and rotate the shank 200 to screw into or from the distal end of the drill string.

During drilling operations, the drill bit 100 is positioned at the bottom of a well bore hole and rotated. Drilling fluid is pumped through the inside of the bit body 110, and out through nozzles (not shown) on the face 120. As the drill bit 100 is rotated, the PDC cutting elements 180 scrape across and shear away the underlying earth formation material. The formation cuttings mix with the drilling fluid and pass through the fluid courses 140 and then through the junk slots 150, up through an annular space between the wall of the bore hole and the outer surface of the drill string to the surface of the earth formation.

Often, the bore hole is designed to include one or more deviations or "dog legs" to arrive at the desired ending location from the starting location of the bore hole. Therefore, drilling a bore hole typically requires steering the drill bit through the predetermined path to arrive at the desired location. The total gage length of a drill bit is the axial length from the point where the cutting structure (cutting elements) disposed over the bit face reaches full diameter to the top (trailing end) of the gage section. Conventional drill bits used in steerable assemblies typically employ a short gage length since the side cutting ability of the bit required to initiate a dog leg or deviation is adversely affected by the bit gage length. In other words, if the gage length is longer, a conventional drill bit does not perform well in forming the dog leg.

BRIEF SUMMARY

Various embodiments of the present invention comprise earth-boring tools including a sleeve structure extending the effective gage length of the earth-boring tool and reducing the distance between the top of the gage section to the point of attachment of the tool to a drill string. In one or more embodiments, the earth-boring tool may comprise a bit body comprising a face at a distal end thereof and a plurality of blades extending radially outward over the face and forming gage regions. A shank may be coupled and secured to the bit body and may include a shoulder and a threaded portion for connecting to a drill string. A sleeve structure may be positioned adjacent to the proximal end of the bit body and surround a portion of the shank. An outer surface of the sleeve structure may comprise a plurality of gage pads extending thereover as well as a plurality of breaker flats.

Other embodiments comprise methods for forming an earth-boring tool. One or more embodiments of such methods may comprise forming a bit body comprising a face including a plurality of blades thereon. A shank may be secured to the bit body and may comprise a shoulder between a proximal portion and a distal portion thereof. A sleeve structure may be positioned adjacent to the bit body and may comprise a plurality of gage pads extending from a distal end adjacent the bit body to substantially proximate to the shoulder of the shank.

DETAILED DESCRIPTION

The illustrations presented herein are, in some instances, not actual views of any particular drill sleeve or drill bit, but are merely idealized representations which are employed to describe the present invention. Additionally, elements common between figures may retain the same numerical designation.

Figure 2:
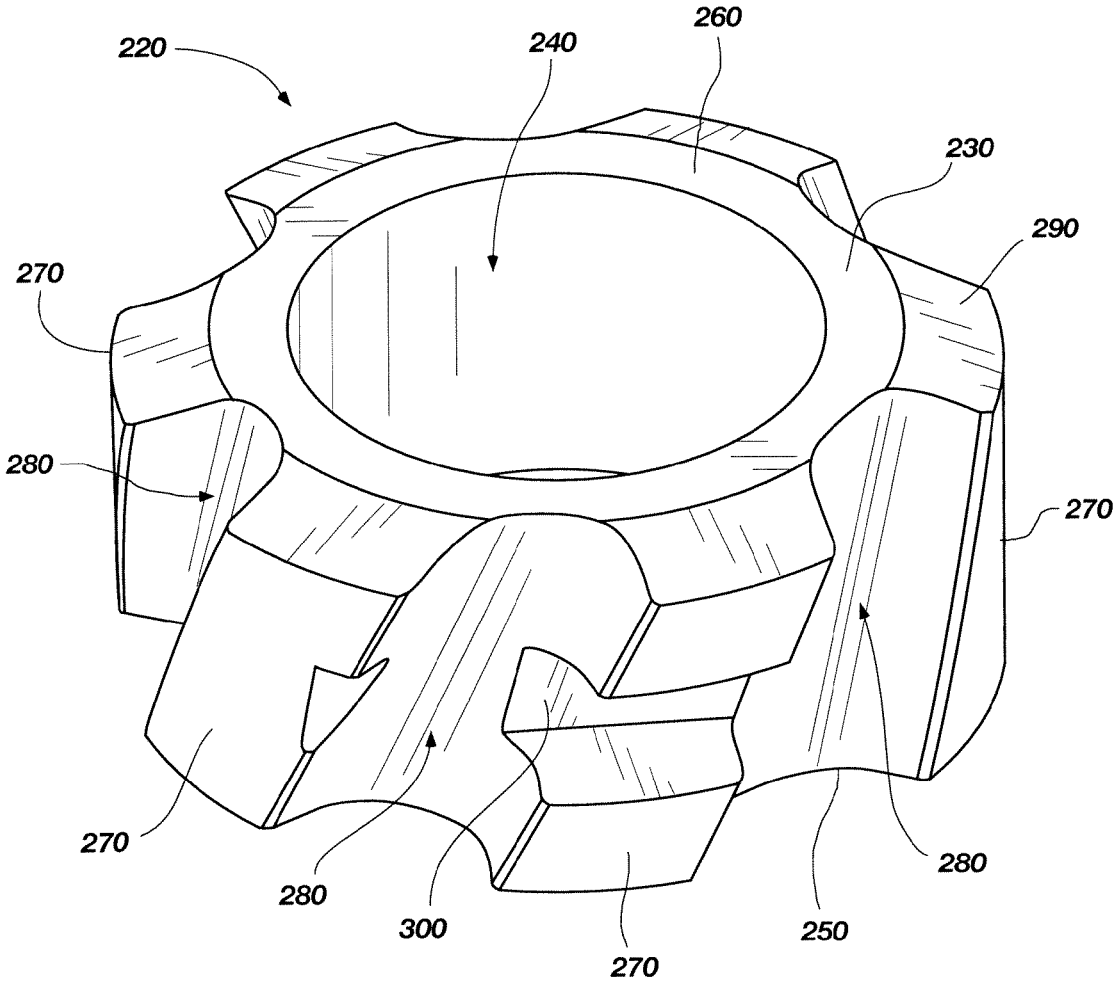
FIG. 2 illustrates an isometric view of a sleeve structure according to one embodiment of the present invention.

Various embodiments of the present invention are directed toward a drill sleeve or sleeve structure for attachment adjacent the proximal end of a drill bit. The drill sleeve extends the effective length of the drill bit gage and shortens the length between the gage and the shoulder of the bit located on a shank. FIG. 2 illustrates an isometric view of a sleeve structure 220 according to one embodiment. The sleeve structure 220 comprises a body 230 which may have a generally cylindrical shape. The body 230 may be formed from a durable material, such as those materials commonly known for use with conventional earth-boring tools. By way of example only, the body 230 may be made from a metal or metal alloy such as steel, or a particle-matrix composite material. The body 230 of the sleeve structure 220 comprises a generally cylindrical shape including an axial opening or aperture 240 through a central portion thereof. The aperture 240 may be sized and configured to fit around an outer surface of a shank.

The sleeve structure 220 comprises a distal end 250 and a proximal end 260. The distal end 250 is configured to mate with a proximal end of a drill bit as described in more detail below. A plurality of blade-like features in the form of gage pads 270 extend at least substantially between the distal end 250 and the proximal end 260. Such gage pads 270 may extend substantially longitudinally straight in some embodiments, or the gage pads 270 may extend in a substantially helical fashion in other embodiments between the distal end 250 and the proximal end 260. A plurality of junk slots 280 are formed between circumferentially adjacent gage pads 270. The plurality of junk slots 280 extend in the same orientation as the adjacent gage pads 270. For example, if the gage pads 270 extend longitudinally straight, then the junk slots 280 will also extend straight. Similarly, if the gage pads 270 extend helically, then the junk slots 280 will also extend helically.

Figure 3:
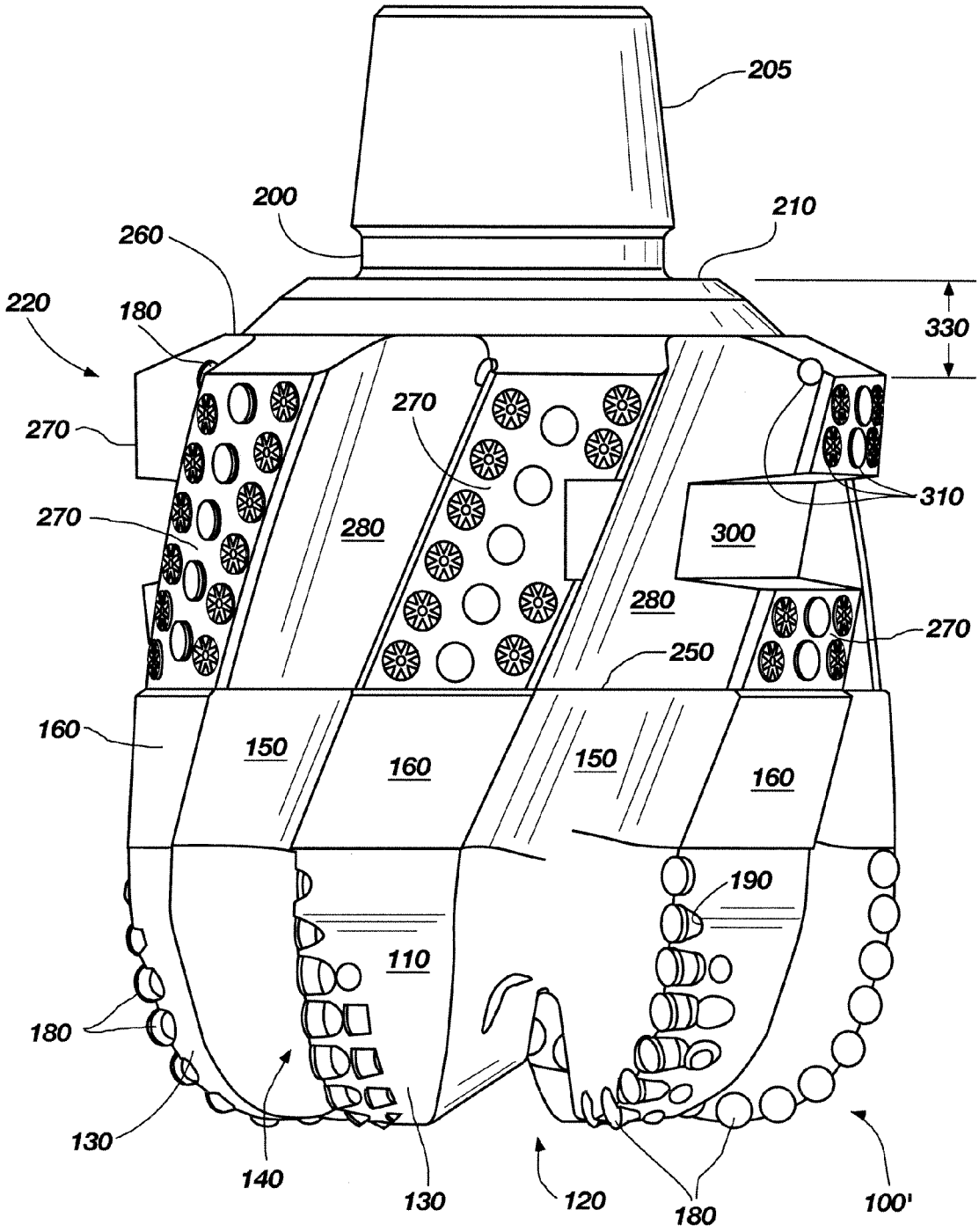
FIG. 3 depicts an elevation view of an earth-boring tool according to an embodiment of the invention.

At the proximal end, the gage pads 270 may comprise a transfer region 290, depicted in FIG. 2 as a chamfer, to aid in removing the drill bit to which the sleeve structure 220 is coupled. The transfer region 290 configured as a chamfer may reduce the chances that the drill bit to which the sleeve structure 220 is coupled will get hung up on a ledge or other irregularity on the bore hole wall or on other subterranean material when removing the drill bit from the bore hole. The angle of the transfer region 290 may be selected according to the specific application and according to the desired distance from the proximal end of the gage pads 270 to the shank shoulder 210 (FIG. 3). In some embodiments, the sleeve structure 220 includes a set of breaker flats 300 comprising radially interior sides of slots or notches in some of the gage pads 270 to aid in attaching and removing the drill bit to and from a bottom hole assembly. The breaker flats 300 enable the sleeve structure 220 to surround and cover up a portion of the underlying bit shank, which typically has similar features, while providing structure for mechanically, rotationally engaging the assembly.

A plurality of wear resistant inserts 310 (FIG. 3) and/or coatings may be positioned on radially outer surfaces of the gage pads 270 in some embodiments as known in the art to inhibit excessive wear thereto. Examples of such wear resistant inserts 310 and/or coatings may include hardfacing material, tungsten carbide inserts, natural or synthetic diamonds, or a combination thereof. By way of example and not limitation, suitable inserts 310 may comprise BRUTE® cutters, superabrasive or tungsten carbide ovoids, or tungsten carbide bricks or discs, as well as any other inserts known to those of ordinary skill in the art. In some embodiments, such as that shown in FIG. 3, the sleeve structure 220 may include a plurality of wear resistant inserts 310 configured as cutting elements 180 positioned at or near the proximal end 260 of the sleeve structure 220 and on a rotationally leading surface of the gage pads 270 to aid in drilling and/or reaming, including back reaming, with the sleeve structure 220. The plurality of wear resistant inserts 310 may be provided within pockets formed in the longitudinally trailing surfaces of one or more of the gage pads 270 toward the radially outermost extents thereof. Conventionally, a bonding material such as an adhesive or, more typically, a braze alloy may be used to secure the wear resistant inserts 310 to the body 230.

Figure 1:
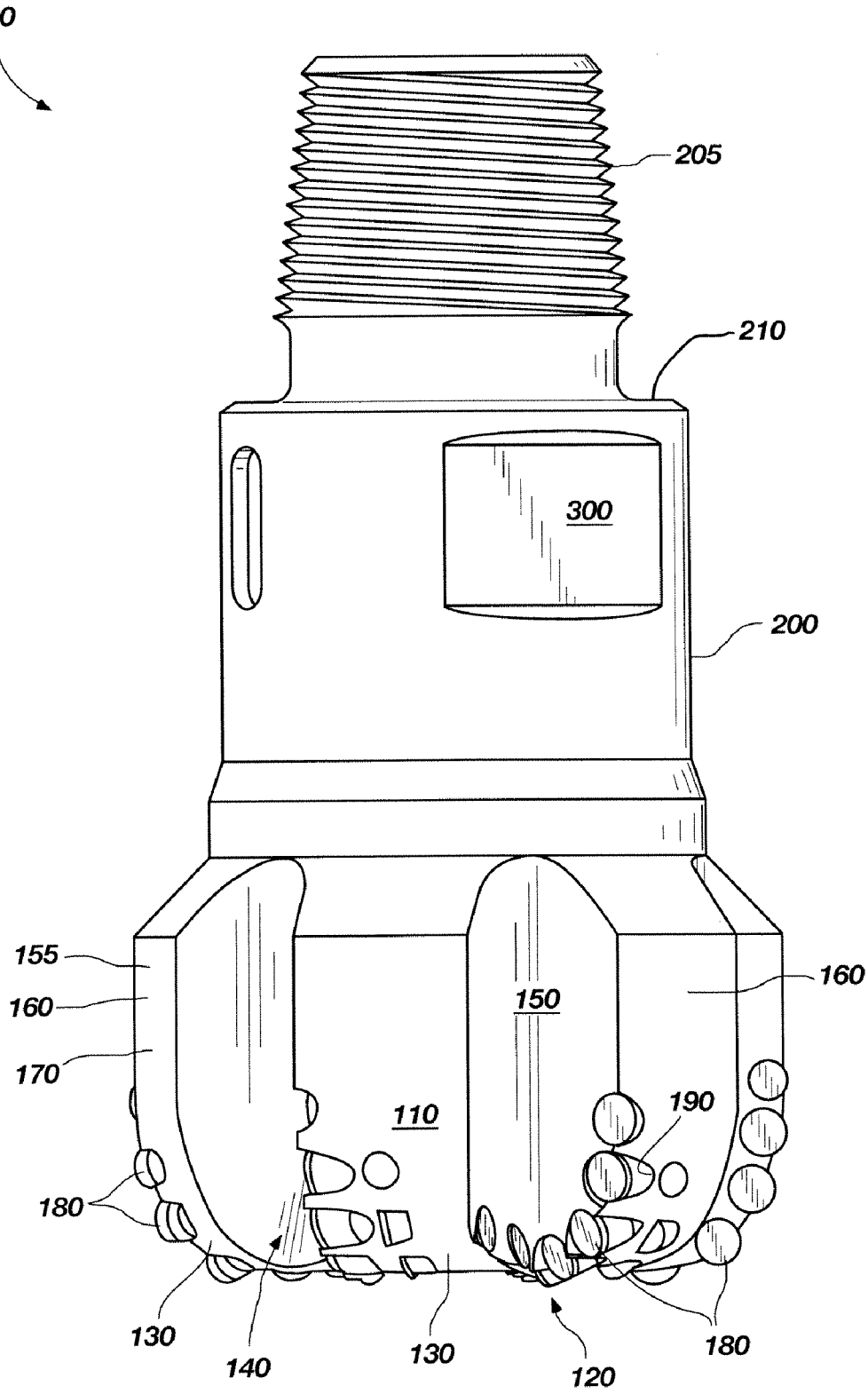
FIG. 1 (PRIOR ART)
FIG. 1 illustrates an elevation view of a conventional fixed-cutter earth-boring rotary drill bit.

The sleeve structure 220 is configured to be coupled to an earth-boring tool for use in forming a bore hole in subterranean features. Accordingly, additional embodiments of the present invention are directed to earth-boring tools which comprise a bit body 110 and a sleeve structure 220 according to various embodiments. FIG. 3 is an elevation view of an earth-boring tool according to one embodiment of the invention. The earth-boring tool comprises a drill bit 100' which may be configured as a fixed cutter drill bit or what is commonly known as a "drag" bit coupled to a sleeve structure 220 according to one embodiment of the present invention. The drill bit 100' may comprise a conventional drill bit including a bit body 110 having a face 120 defining a distal end thereof and a shank 200 at a proximal end thereof. The bit body 110 may include a plurality of blades 130 extending radially outward over the face 120 and forming gage regions 160 at the radially outer surfaces. The shank 200 includes a shoulder 210 and structure comprising a thread connection 205, the thread connection 205 comprising an American Petroleum Institute (API) thread connection for attaching the drill bit 100' to the drill string. By way of example and not limitation, some embodiments of the drill bit 100' may be configured similar to the drill bit 100 shown in FIG. 1 and described herein above.

The sleeve structure 220 is configured to surround a portion of the shank 200 and sit adjacent to the bit body 110. The aperture 240 (FIG. 2) of the sleeve structure 220 may, therefore, be sized and shaped to fit around the outer surface of the shank 200. For example, if the shank 200 is cylindrically shaped, then the aperture 240 will be round and may comprise a diameter slightly larger than the outer diameter of the shank 200 so that the aperture 240 may extend over and adjacent to the shank 200. The distal end 250 of the sleeve structure 220 may be configured to enable the sleeve structure 220 to sit adjacent the proximal end of the bit body 110 so that there is substantially no space at the interface between the outer surface of the bit body 110 and the outer surface of the sleeve structure 220. In other words, the sleeve structure 220 may be configured to mate with the bit body 110 so that the sleeve structure 220 sits firmly against the bit body 110 at the outer surface thereof. Such a configuration may inhibit drilling fluid and/or cuttings from getting between the sleeve structure 220 and the bit body 110. By way of example and not limitation, if the bit body 110 comprises a chamfer at the proximal end thereof, like the bit body of the drill bit in FIG. 1, then the distal end 250 of the sleeve FIG. 1, then the distal end 250 of the sleeve structure 220 may include a similar, mirror-image chamfer on the aperture 240 so that the chamfer on the sleeve structure 220 bounding aperture 240 will mate with the chamfer on the bit body 110 and the outer surface of the distal end 250 of the sleeve structure 220 will mate adjacent the bit body 110 with substantially no space therebetween.

The length of the sleeve structure 220 is selected so that the proximal end 260 thereof is located substantially near the shoulder 210 of the shank 200. The length of the sleeve structure 220 may be selected in relation to the gage length of the bit body 110. In some embodiments, the gage regions 160 on the bit body 110 may comprise a conventional gage length such as is employed in non-directional drilling while in other embodiments the gage regions 160 on the bit body 110 may comprise a relatively shorter gage length. The length of the sleeve structure 220 may, therefore, be selected such that the gage pads 270 extend proximate to the shoulder 210 of the shank 200, to extend the effective length of the gage regions 160 and reduce the length 330 from the proximal end of the gage pads 270 to the shoulder 210 which is just distal to the thread connection 205. The reduction in length 330 reduces the bending moment on the shank 200 caused by any force against the radially outer surface of the sleeve structure 220 by reducing the length of the moment arm between the sleeve structure 220 and the thread connection 205. Furthermore, the reduction in length 330 increases the ability to steer the earth-boring tool in forming a dog leg with less steering force, in turn improving the directional control of the earth-boring tool.

The gage pads 270 of the sleeve structure 220 may be configured to comprise a similar cross-sectional shape, size and orientation as a plurality of gage regions 160 on the bit body 110, the gage regions 160 comprising longitudinal extensions of blades 130. Similarly, the junk slots 280 of the sleeve structure 220 may be configured with a similar shape, size and orientation as the plurality of junk slots 150 on the bit body 110. The sleeve structure 220 may then be positioned adjacent the bit body 110 with gage pads 270 and junk slots 280 of the sleeve structure 220 aligned with respective gage regions 160 and junk slots 150 of the bit body 110. In other words, the gage pads 270 may be positioned to extend along the same path as the gage regions 160 of the bit body 110. Similarly, the junk slots 280 may extend along the same path as the junk slots 150 of the bit body 110. Thus, sleeve structure 220 may create an effective extension of the gage length to at least substantially near the shoulder 210 of the shank 200.

In some embodiments, the sleeve structure 220 may comprise an outer diameter at least substantially equivalent to the outermost radius of the bit body 110 as defined by the gage regions 160. In other embodiments, the sleeve structure 220 may comprise an outer diameter that is less than the outermost radius of the bit body 110. By way of example and not limitation, in some embodiments, the outer diameter of the sleeve structure 220 may be in the range of approximately 1/16-inch to 1/8-inch (approximately 1.5 millimeters to 3.2 millimeters) undersized from the outermost radius of the bit body 110. The outer diameter of the sleeve structure 220 may be selected according to the specific application and considering certain parameters such as, by way of example only, the desired hole quality, the directional drilling requirements of the bit, or both. A computerized bottom hole assembly system analysis may be carried out to simulate the directional behavior of the earth-boring tool and computationally determine a desirable outer diameter of the sleeve structure 220.

The bit body 110 may include a plurality of cutting elements 180 positioned on each of the blades 130. The cutting elements 180 may comprise a "table" of super-abrasive material, such as mutually bound particles of polycrystalline diamond, formed on a supporting substrate of a hard material, conventionally cemented tungsten carbide. Such cutting elements are often referred to as "polycrystalline diamond compact" (PDC) cutting elements or cutters. The plurality of PDC cutting elements 180 may be provided within cutting element pockets 190 formed in rotationally leading surfaces of each of the blades 130. A bonding material such as an adhesive or, more typically, a braze alloy may be used to secure the cutting elements 180 to the bit body 110.

The increase of the effective gage length of the earth-boring tool and the decrease in length 330 between the proximal end of the gage pads 270 to the shoulder 210 is believed to improve directional drilling including the formation of dog legs in a bore hole. The increase in the effective gage length is also believed to contribute to bore hole quality while reducing bottom hole assembly vibrations. Furthermore, the reduction in length 330 increases the ability to steer the earth-boring tool in forming a dog leg with less steering force, in turn improving the directional control of the earth-boring tool.

Figure 5:
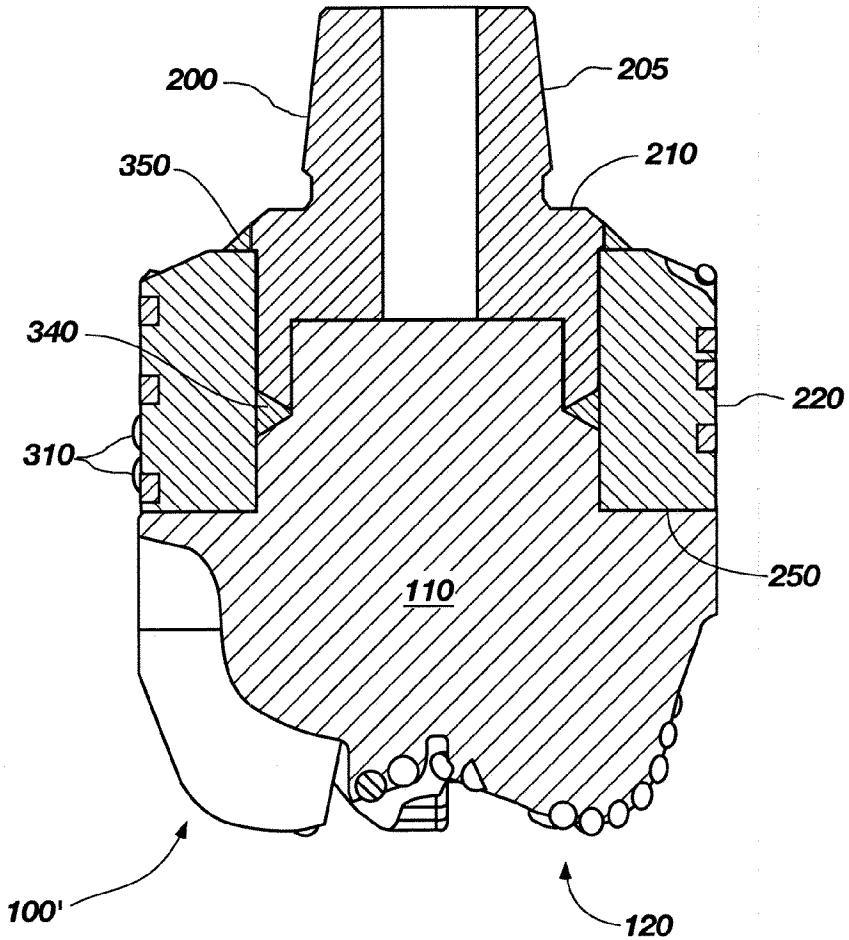
FIG. 5 depicts a cross-sectional view of the bit body and shank of FIG. 4 including a sleeve structure coupled thereto according to one embodiment.
Figure 4:
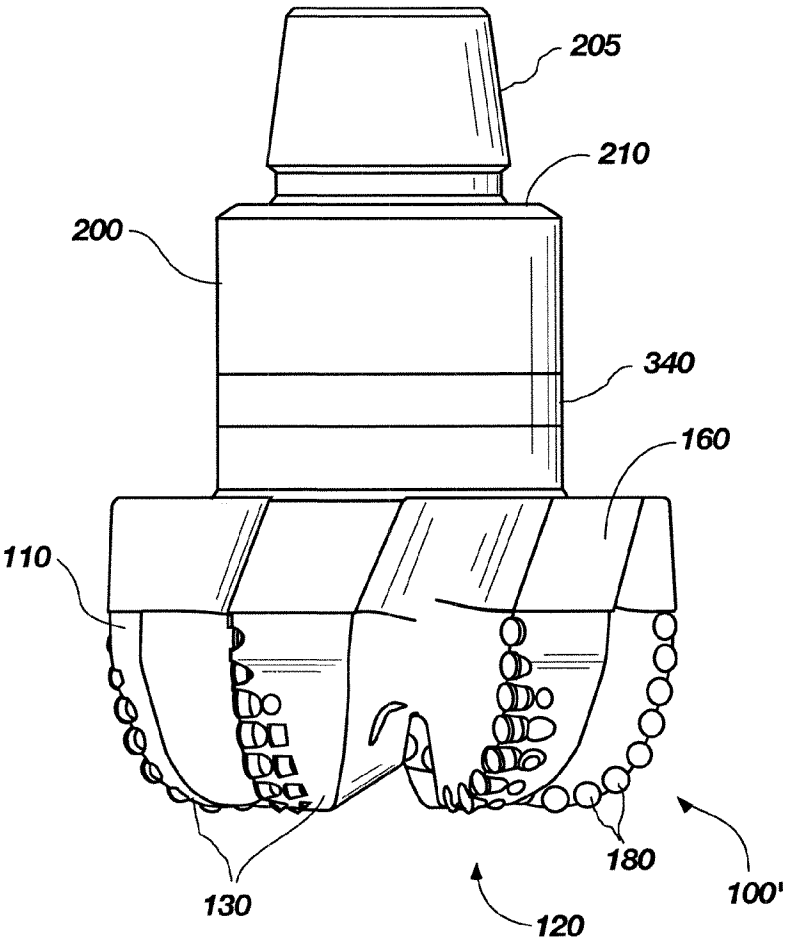
FIG. 4 is an elevation view of a bit body and shank according to one embodiment of the invention.

Further embodiments of the present invention are directed to methods of forming earth-boring tools which comprise a bit body 110 and a sleeve structure 220 according to various embodiments. Referring to FIGS. 4 and 5, a bit body 110 may be formed and coupled to a shank 200. The bit body 110 may comprise a face 120 including a plurality of blades 130 extending radially outward and forming gage regions 160. Furthermore, a plurality of cutting elements 180 may be secured on the face 120 of the bit body 110. The bit body 110 as well as the sleeve structure 220 may comprise a metal or metal alloy, such as steel, or a particle-matrix composite material. In the case of a particle-matrix composite material, the bit body or sleeve structure body may be formed by structure body may be formed by conventional infiltration methods (in which hard particles (e.g., tungsten carbide) are infiltrated by a molten liquid metal matrix material (e.g., a copper-based alloy) within a refractory mold), as well as by newer methods generally involving pressing a powder mixture to form a green powder compact, and sintering the green powder compact to form a bit body. The green powder compact may be machined as necessary or desired, prior to sintering, using conventional machining techniques like those used to form steel bit bodies. Furthermore, additional machining processes may be performed after sintering the green powder compact to a partially sintered brown state, or after sintering the green powder compact to a desired final density.

The shank 200 may be formed comprising a distal portion which may be attached to the bit body 110 and a proximal portion including structure comprising an American Petroleum Institute (API) thread connection 205 for attachment to a drill string. The transition between the distal portion and the proximal portion comprises a shoulder 210 which is at the distal end of the thread connection 205. The shank 200 is attached to the bit body 110 by securing the shank 200 to the bit body 110 with weld 340. The weld 340 may be formed by any conventional welding process as is known to those of ordinary skill in the art. Other methods of securing a shank to a bit body are also known, and may be employed.

A sleeve structure 220 is formed comprising a body 230 including an aperture 240 through a central region thereof. The distal end 250 is configured to couple with the bit body 110 with the sleeve structure 220 positioned adjacent the bit body 110. The sleeve structure 220 is formed with a plurality of gage pads 270 extending upward (as the bit is oriented during use) from the distal end 250 to the proximal end 260 of the sleeve structure 220, the proximal end 260 being substantially near the shoulder 210 of the shank 200. The sleeve structure 220 is secured in place adjacent the bit body 110 with another weld 350 between at least one of the bit body 110 and the shank 200 and the sleeve structure 220. In the embodiment shown in the FIG. 5, the sleeve structure 220 may be secured to the bit body 110 and shank 200 by forming weld 350 between the sleeve structure 220 and the shank 200.

One or more wear resistant inserts 310 and/or a wear resistant coating may be disposed on a radially outer surface of the plurality of gage pads 270 of the sleeve structure 220. Wear resistant inserts 310 as discussed above may be attached to the gage pads 270 using a bonding material such as an adhesive or, more typically, a braze alloy may be used to secure the wear resistant inserts 310 to the gage pads 270. A wear resistant coating may comprise a hardfacing or similar material. The wear resistant coating may be disposed over at least the radially outer surface of the plurality of gage pads 270 employing a conventional welding process such as oxy-acetylene, MIG, TIG, SMA, SCA, PTA, etc.

While the present invention has been described herein in relation to embodiments of earth-boring rotary drill bits that include fixed cutters, other types of earth-boring tools such as, for example, core bits, eccentric bits, bicenter bits, reamers, mills, roller cone bits, and other such structures known in the art may incorporate embodiments of the present invention and may be formed by methods according to embodiments of the present invention, and, as used herein, the term "bit body" encompasses bodies of earth-boring rotary drill bits, as well as bodies of other earth-boring tools including, but not limited to, core bits, eccentric bits, bicenter bits, reamers, mills, roller cone bits, as well as other drilling and downhole tools.

While certain embodiments have been described and shown in the accompanying drawings, such embodiments are merely illustrative and not restrictive of the scope of the invention, and this invention is not limited to the specific constructions and arrangements shown and described, since various other additions and modifications to, and deletions from, the described embodiments will be apparent to one of ordinary skill in the art. Thus, the scope of the invention is only limited by the literal language, and legal equivalents, of the claims which follow.

What is claimed is:

1. An earth-boring tool, comprising:

a bit body including a distal portion comprising a diameter and a proximal portion of lesser lateral extent than the diameter;

a shank having a distal portion of a lateral extent equal to the lateral extent of the proximal portion of the bit body, the distal portion of the shank and the proximal portion of the bit body being coupled, and the shank including a thread connection at a proximal end thereof for connecting to a drill string; a sleeve structure longitudinally abutting the distal portion of the bit body and extending over the proximal portion of the bit body and at least part of the distal portion of the shank, the sleeve structure comprising a plurality of gage pads extending thereover circumferentially separated by junk slots in alignment with junk slots of the distal portion of the bit body; and two diametrically opposed breaker flats positioned in radially outer surfaces of gage pads of the sleeve structure, each breaker flat comprising portions of two circumferentially adjacent gage pads of the sleeve.

2. The earth-boring tool of claim 1, wherein the bit body comprises a material selected from the group consisting of a metal, a metal alloy, and a particle-matrix composite.

3. The earth-boring tool of claim 1, wherein the sleeve structure comprises a material selected from the group consisting of a metal, a metal alloy, and a particle-matrix composite.

4. The earth-boring tool of claim 1, wherein the sleeve structure comprises an outermost diameter less than an outermost diameter of the bit body.

5. The earth-boring tool of claim 1, wherein the plurality of gage pads of the sleeve structure extend substantially helically from a distal end to a proximal end thereof.

6. An earth-boring tool, comprising:

a bit body having a face of a diameter at a distal end thereof including a plurality of generally radially extending blades and a proximal end of lesser diameter;

a shank secured to and extending longitudinally from the proximal end of the bit body, the shank having a distal end secured to the proximal end of the bit body and of substantially equal diameter thereto, the shank including a shoulder at a distal end of a threaded structure of a proximal end of the shank for connecting to a drill string; and a sleeve structure around and adjacent the proximal end of the bit body and the distal end of the shank, the sleeve structure abutting the distal end of the bit body and extending longitudinally to proximate the shoulder of the shank, the sleeve structure comprising a plurality of gage pads aligned with gage pads extending longitudinally from the blades of the distal end of the bit body and circumferentially spaced by junk slots circumferentially aligned with junk slots of the distal end of the bit body;

wherein the sleeve structure comprises a surface having an outermost diameter undersized from an outermost diameter of a surface of the bit body.

7. The earth-boring tool of claim 6, wherein the plurality of gage pads of the sleeve structure extend substantially helically from a distal end to a proximal end thereof.

8. The earth-boring tool of claim 6, further comprising at least one cutting element positioned on a rotationally leading face of at least one gage pad of the plurality of gage pads.

9. The earth-boring tool of claim 6, further comprising two diametrically opposed breaker flats positioned in radially outer surfaces of gage pads of the sleeve structure, each breaker flat comprising portions of two circumferentially adjacent gage pads of the sleeve.

10. The earth-boring tool of claim 6, wherein the bit body comprises a material selected from the group consisting of a metal, a metal alloy, and a particle-matrix composite.

11. The earth-boring tool of claim 6, wherein the sleeve structure comprises a material selected from the group consisting of a metal, a metal alloy, and a particle-matrix composite.

12. An earth-boring tool, comprising:

a bit body having a face of a diameter at a distal end thereof including a plurality of generally radially extending blades and a proximal end of lesser diameter;

a shank secured to and extending longitudinally from the proximal end of the bit body, the shank having a distal end secured to the proximal end of the bit body and of substantially equal diameter thereto, the shank including a shoulder and structure for connecting to a drill string;

a sleeve structure around and adjacent the proximal end of the bit body and the distal end of the shank, the sleeve structure abutting the distal end of the bit body and extending longitudinally to substantially the shoulder of the shank, the sleeve structure comprising a plurality of gage pads aligned with gage pads extending longitudinally from the blades of the distal end of the bit body and circumferentially spaced by junk slots circumferentially aligned with junk slots of the distal end of the bit body; and two diametrically opposed breaker flats positioned in radially outer surfaces of gage pads of the sleeve structure, each breaker flat comprising portions of two circumferentially adjacent gage pads of the sleeve.

* * * * *